US006136485A

United States Patent [19]

Ishida et al.

[11] Patent Number: 6,136,485

[45] Date of Patent: Oct. 24, 2000

[54] ELECTROPHOTOGRAPHIC PHOTORECEPTOR, PROCESS FOR PRODUCTION THEREOF, AND IMAGE-FORMING APPARATUS USING SAME

[75] Inventors: Kazuya Ishida, Kashiba; Satoshi Katayama, Nabari; Takahiro Teramoto, Tenri; Akihiko Kawahara, Nara; Kazushige Morita, Kitakatsuragi-gun; Tomoko Kanazawa, Kashihara, all of Japan

[73] Assignee: Sharp Kabushiki Kaisha, Osaka, Japan

[21] Appl. No.: 09/188,342

[22] Filed: Nov. 9, 1998

[30] Foreign Application Priority Data

Dec. 26, 1997 [JP] Japan ..... 9-360657

[51] Int. Cl.[7] ..... G03G 5/14

[52] U.S. Cl. ..... 430/65; 430/131

[58] Field of Search ..... 430/65, 63, 131

[56] References Cited

U.S. PATENT DOCUMENTS

| | | | |
|---|---|---|---|
| 3,899,327 | 8/1975 | Esser et al. | 430/63 |
| 4,456,670 | 6/1984 | Nakayama et al. | 430/63 |
| 5,804,343 | 9/1998 | Umeda et al. | 430/59 |

FOREIGN PATENT DOCUMENTS

| | | |
|---|---|---|
| 0 576 957 A2 | 1/1994 | European Pat. Off. . |
| 1935718 | 5/1970 | Germany . |
| 63-178249 | 7/1983 | Japan . |
| 59-93453 | 5/1984 | Japan . |
| 63-298251 | 12/1988 | Japan . |
| 6-59489 | 3/1994 | Japan . |

OTHER PUBLICATIONS

Database WPI, Section Ch, Week 8649, Derwent Publications Ltd., London, GB; Class A14, AN 86–322972 XP002099146 & JP 61 240247 A (Canon KK) Oct. 25, 1986.

Database WPI, Section Ch, Week 8822, Derwent Publications Ltd., London, GB; Class A89, AN 88–151080 XP002099147 & JP 63 091665 A (RICOH KK) Apr. 22, 1988.

Database WPI, Section Ch, Week 9039, Derwent Publications Ltd., London, GB; Class A89, AN 90–294355 XP002099148 & JP 02 207268 A (Fuji Xerox Co Ltd) Aug. 16, 1990.

Patent Abstracts of Japan, vol. 096, No. 010, Oct. 31 1996 & JP 08 166677 A (Mitsubishi Paper Mills Ltd) Jun. 25, 1996.

*Primary Examiner*—Christopher D. Rodee
*Attorney, Agent, or Firm*—Nixon & Vanderhye

[57] ABSTRACT

The object of the invention is to provide a highly characteristic and lesser defective image using an electrophotographic photoreceptor which can be produced with a better coating property and which is highly sensitive and hardly loses the electrostatic stability during repeated use. A water-soluble or water/alcohol-soluble polyvinyl acetal and an inorganic pigment are involved in an underlayer provided between a conductive support and a photoconductive layer. Particularly, it is favorable to use titanium oxide as the inorganic pigment, make the ratio of polyvinyl acetal/titanium oxide 1/9–9/1 by weight, make the underlayer 0.5–5 $\mu$m in thickness, use the titanium oxide of which the surface is treated with alumina, use the titanium oxide of which the titanium oxide component is 95% by weight or lower and of which the surface is treated with alumina, use the polyvinyl acetal of which the sodium ion concentration is 40 ppm or lower, and use the photo-conductive layer which contains a vinyl chloride-vinyl acetate type copolymer. As for a dispersing medium for coating the underlayer, water/alcohol=1/9–7/3 (ratio by weight) is selected. The aforementioned photoreceptor is applied to an image-forming apparatus using an inversion development process.

8 Claims, No Drawings

ELECTROPHOTOGRAPHIC PHOTORECEPTOR, PROCESS FOR PRODUCTION THEREOF, AND IMAGE-FORMING APPARATUS USING SAME

BACKGROUND OF THE INVENTION

1. Field of the Invention

The present invention relates to an electro-photographic photoreceptor having a photoconductive layer on a conductive support via an underlayer, a process for producing the same, and an image-forming apparatus using the same.

2. Description of the Related Art

In a process for electrophotography, one of general information recording methods, utilizing photoconductive phenomena of a photoreceptor, a surface of the photoreceptor is uniformly charged by corona discharge in a dark place, and then the charge of the photo-exposed portion is selectively discharged by image exposure to form an electrostatic latent image at the non-exposed portion. After that, colored charged corpuscles (toner) are adhered to the electrostatic latent image to generate an image as a visual picture. In a sequence of these processes, the followings are requisite basic characteristics of the photoreceptor:

(1) Uniformly chargeable at an appropriate electric potential in a dark place;

(2) Having a potent charge capacity with little discharge in a dark place; and (3) Superior in photosensitivity to release the electric charge rapidly by photo-irradiation. In addition, high stability and durability are required as follows: readily removable charge from the surface of photoreceptor; small residual electric potential; high mechanical strength; good flexibility; unchangeable electrical characteristics in repeated use, particularly, electrically charged property, photosensitivity and residual electric potential; and durability against heat, light, temperature, humidity and ozone.

In the electrophotographic photoreceptor which has such a structure that a photoreceptive layer is formed as a photoconductive layer over a conductive support, the surface electric charge is microscopically lost or reduced to generate a defect of image because carrier injection is readily caused from the conductive support in the photoreceptive layer. In order to prevent it and improve defective coating and electrically charged property on the surface of conductive support, adhesive property of the photoreceptive layer, and easiness of the application, an underlayer is provided between the conductive support and the photoreceptive layer.

As for adhesive resin materials for forming the underlayer, polyethylene, polypropylene, polystyrene, acrylic resin, vinyl chloride resin, vinyl acetate resin, polyurethane resin, epoxy resin, polyester resin, melamine resin, silicon resin, poly(vinyl butyral) resin, polyamide resin, copolymer resin containing two or more of their repeating units, casein, gelatin, polyvinyl alcohol, ethylcellulose, and water-soluble polyvinyl acetal resin are included.

Japanese Unexamined Patent Publication (Toku-Kai-Sho; hereinafter referred to as JP-A) 63-178249 discloses a photoreceptor having an intermediate layer between the conductive support and the photoreceptive layer, in which the intermediate layer is composed of a water-soluble polyvinyl acetal resin as a major component, or in which an underlayer consisting of dispersed white pigment such as titanium oxide is provided between the conductive support and the intermediate layer. This intermediate layer is provided for preventing the carrier injection from the conductive support into the photoreceptive layer. The underlayer is provided for preventing interference of light in order to apply the photoreceptor to an image-forming apparatus using a laser light source. In this official gazette, high sensitivity of the photoreceptor is intended to be maintained in repeated use in a condition of lower temperature and lower humidity or of higher temperature and higher humidity. So, electrostatic property of the photoreceptor has been evaluated before and after one-hour exposure is repeated under a variety of environments.

JP-A 6-59489 discloses a photoreceptor in which an underlayer containing as a major component polyvinyl acetal resin soluble in a mixture of water and alcohol is provided between the conductive support and the photoreceptive layer. The underlayer is provided for the purpose of improving adhesion between the conductive support and the photoreceptive layer and maintaining the sensitivity in repeated use. In this official gazette, the electrostatic and image characteristics of the prepared photoreceptor are evaluated before and after the repeated exposure of 10,000 times.

In both of JP-A 63-178249 and JP-A 6-59489, however, increase of the residual electric potential and occurrence of the image defect in repeated use cannot be reduced sufficiently due to single use of the resin.

On the other hand, another underlayer has been disclosed, in which an inorganic pigment is dispersed into the adhesive resin. JP-A 59-93453 discloses an example of the use of surface-treated titanium oxide as an inorganic pigment. According to this official gazette, uneven coating or uneven film thickness caused by rough surface of the conductive support can be avoided without any cutting working or polishing of mirror surface, and dispersibility is increased by treatment of the surface of titanium oxide with a coating agent such as alumina in order to prevent image defect or uneven concentration.

JP-A 63-298251 discloses an example in which a ratio of titanium oxide to an adhesive resin is in a range of 1/1–3/1 by volume. In this official gazette, the content of titanium oxide is optimized intending prolongation of the life span of the photoreceptor, and the electrostatic property of the prepared photoreceptor is evaluated before and after the repeated exposure of 100,000 times.

In JP-A 59-93453 and JP-A 63-298251, increase of the residual electric potential and occurrence of the image defect in repeated use are not reduced sufficiently. Accordingly further improvement is desired.

SUMMARY OF THE INVENTION

An object of the invention is to provide an electrophotographic photoreceptor of which the photoreceptive characteristic is hardly damaged in repeated use. Another object of the invention is to provide a process for producing an electrophotographic photoreceptor which can be produced with a highly dispersible liquid coating material. Further object of the invention is to provide an image-forming apparatus by which an image of high image characteristic can be generated using such a photoreceptor.

The invention relates to an electrophotographic photoreceptor comprising a photoconductive layer provided on a conductive support via an underlayer, wherein the underlayer contains an inorganic pigment and a water-soluble polyvinyl acetal.

According to the invention, the electrostatic stability in repeated use is improved by that the inorganic pigment and the water-soluble polyvinyl acetal are involved in the underlayer provided between the conductive support and the photoconductive layer.

Moreover, the invention is characterized in that titanium oxide is selected as the inorganic pigment.

According to the invention, the selection of titanium oxide as an inorganic pigment improves the sensitivity and the electrostatic stability in repeated use.

Moreover, the invention is characterized in that a weight ratio of the titanium oxide to the water-soluble polyvinyl acetal is in a range of 1/9–9/1 (titanium oxide/water-soluble polyvinyl acetal).

According to the invention, the sensitivity and the electrostatic stability in repeated use are improved by fixing the ratio of titanium oxide to water-soluble polyvinyl acetal in a range of 1/9–9/1 by weight.

Furthermore, the sensitivity and the electrostatic stability in repeated use are further improved by fixing the underlayer thickness in a range of 0.5–5 $\mu$m.

Moreover, the invention is characterized in that the titanium oxide is treated with alumina.

According to the invention, the use of titanium oxide coated with alumina by surface treatment improves the sensitivity and the electrostatic stability in repeated use. The image generated by such a photoreceptor possesses lesser defect and shows a very favorable characteristic.

Furthermore, the use of surface-treated titanium oxide containing a titanium oxide component in a range of 95% by weight or lower improves the sensitivity. The image generated by such a photoreceptor possesses little defect and shows a very good characteristic.

Moreover, the invention is characterized in that a sodium ion concentration in the water-soluble polyvinyl acetal is 40 ppm or lower.

According to the invention, by use of the water-soluble polyvinyl acetal in which the sodium ion concentration is 40 ppm or lower, the image generated by such a photoreceptor possesses lesser defect and shows a very favorable characteristic.

Moreover, the invention is characterized in that the photoconductive layer contains a copolymer of vinyl chloride-vinyl acetate type.

According to the invention, the use of the photoconductive layer containing a copolymer of vinyl chloride-vinyl acetate type yields very good sensitivity. The use of such a photoreceptor generates an image having a very favorable characteristic.

Moreover, the invention provides a process for producing an electrophotographic photoreceptor comprising a photoconductive layer on a conductive support via an underlayer, the process comprising forming the underlayer by applying a liquid coating material for forming the underlayer, wherein the underlayer contains an inorganic pigment, a water-soluble polyvinyl acetal and a mixture of water and alcohol.

According to the invention, the underlayer is formed by applying on the conductive support a liquid coating material for forming the underlayer, which contains an inorganic pigment, a water-soluble polyvinyl acetal and a mixture of water and alcohol, and then the photocoductive layer is formed thereon. Since the liquid coating material for forming the underlayer is highly dispersible, a uniform underlayer is formed, which is very favorable in stability in repeated use.

Moreover, the invention is characterized in that a ratio of water to alcohol in the mixture is in a range of 1/9–7/3 (as water/alcohol) by weight.

According to the invention, the selection of a water/alcohol mixture in a range of 1/9–7/3 by weight affords a more highly dispersible liquid undercoating material, by which a uniform underlayer is formed. Furthermore, an excellent electrostatic stability is attained in repeated use.

Moreover, the invention provides an electro-photographic photoreceotor comprising a photoconductive layer provided on a conductive support via an underlayer, wherein the underlayer contains an inorganic pigment and a polyvinyl acetal soluble only in a mixture of water and alcohol.

According to the invention, the inorganic pigment and the polyvinyl acetal soluble only in a mixture of water and alcohol are included in the underlayer provided between the conductive support and the photoconductive layer, by which an excellent electrostatic stability is attained in repeated use.

Moreover, the invention is characterized in that titanium oxide is selected as the inorganic pigment.

According to the invention, the selection of titanium oxide as inorganic pigment affords high sensitivity and an excellent electrostatic stability in repeated use.

Moreover, the invention is characterized in that a ratio of titanium oxide to the polyvinyl acetal soluble only in a mixture of water and alcohol is in a range of 1/9–9/1 (as titanium oxide/polyvinyl acetal) by weight.

According to the invention, the selection of the ratio of titanium oxide to the polyvinyl acetal soluble only in a mixture of water and alcohol in a range of 1/9–9/1 by weight affords high sensitivity and an excellent electrostatic stability in repeated use.

Furthermore, the thickness of the underlayer in a range of 0.5–5 $\mu$m affords high sensitivity and an excellent electrostatic stability in repeated use.

Moreover, the invention is characterized in that titanium oxide is treated with alumina.

According to the invention, the use of the titanium oxide coated with alumina by surface treatment affords high sensitivity and an excellent electro-static stability in repeated use. The image generated by such a photoreceptor possesses lesser defect and shows a very favorable characteristic.

Furthermore, the use of the surface-treated titanium oxide containing a titanium oxide component in a range of 95% by weight or lower improves the sensitivity. An image showing a very favorable characteristic is formed by such a photoreceptor.

Moreover, the invention is characterized in that a sodium ion concentration in the polyvinyl acetal soluble only in a mixture of water and alcohol is 40 ppm or lower.

According to the invention, by use of the polyvinyl acetal in which the sodium ion concentration is 40 ppm or lower, the image generated by such a photo-receptor possesses a very favorable characteristic.

Moreover, the invention is characterized in that the photoconductive layer contains a copolymer of vinyl chloride-vinyl acetate type.

According to the invention, the use of the photoconductive layer containing a copolymer of vinyl chloride-vinyl acetate type affords very good sensitivity. The image generated by use of such a photoreceptor has a very good characteristic.

The electrophotographic photoreceptor may be prepared by applying a liquid coating material for forming the underlayer on the conductive support to form an underlayer and then forming a photoconductive layer thereon, wherein the liquid coating material contains an inorganic pigment, a polyvinyl alcohol soluble only in a mixture of water and alcohol, and a mixture of water and alcohol. The resulting liquid coating material for forming the underlayer is highly dispersible to form a uniform underlayer, of which degeneration of the photoreceptive characteristic can be reduced in repeated use.

Moreover, setting the weight mixing ratio of water to alcohol in the mixture as solvent in 1/9–7/3 affords a more highly dispersible liquid coating material for forming the underlayer, by which a uniform underlayer can be formed.

Moreover, the invention also relates to an image-forming apparatus which forms an image by an inversion development process using an electro-photograpic photoreceptor, wherein the electro-photographic photoreceptor comprises a photoconductive layer provided on a conductive support via an underlayer, which contains an inorganic pigment and a water-soluble polyvinyl acetal, or titanium oxide as the inorganic pigment and a polyvinyl acetal soluble only in a mixture of water and alcohol.

According to the invention, by applying the image-forming apparatus which forms an image from the photoreceptor by an inversion development process, an image of high image characteristic which is highly sensitive and much favorable in electrostatic stability can be generated.

The polyvinyl acetal resin of the invention, which is contained in the underlayer and soluble in water or water/alcohol, is different from the usual polyvinyl acetal in view of the lowered acetal formation degree. The resin contains a large quantity of vinyl alcohol component in the constitutional unit and is well soluble in water and such an alcohol as methanol, ethanol, propanol, butanol and ethylene glycol, but practically insoluble in a usual organic solvent. Such resin includes polyvinyl burytal, polyvinyl formal and polyvinyl acetoacetal. The water-soluble polyvinyl acetal is commercially available as Essreck KW (Sekisui Chemical Co., Ltd.), and the water/alcohol-soluble polyvinyl acetal as Essreck KX (Sekisui Chemical Co., Ltd.); they are readily available. Essreck KX is soluble only in a mixture of water and alcohol, but not in water or alcohol alone.

The inorganic pigment of the invention, which is contained in the underlayer and combined with a polyvinyl acetal soluble in water or water/alcohol, includes titanium oxide, tin oxide, zinc oxide, aluminum oxide, calcium carbonate, barium sulfate, antimony oxide, iridium oxide and zirconium oxide; particularly, titanium oxide is preferable in view of its characteristics. These inorganic pigments, if required, may be surface-treated with an inorganic material such as alumina or silica or with an organic material such as stearic acid.

With respect to improvement of the characteristics of the photoreceptor having the underlayer which contains a water- or water/alcohol-soluble polyvinyl acetal and an inorganic pigment, decrease of the residual electric potential is exemplified as electrostatic characteristic. Hitherto, though it has been attempted very often to reduce the residual electric potential by employing an underlayer which is prepared by combining an inorganic pigment with an alcohol- soluble resin such as alcohol-soluble nylon, increase of the residual electric potential could not be improved sufficiently since the resin per se has a disadvantage that its resistance becomes higher at lower temperatures and lower humidity. In the water- or water/alcohol-soluble polyvinyl acetal, degree of the resistance increase at lower temperatures and lower humidity is lower than that of the alcohol-soluble resin. When the resin is used alone as the underlayer, its residual potential is smaller than that of the alcohol-soluble nylon. When the resin is combined with an inorganic pigment as in this invention, the electroconductivity of the inorganic pigment assists movement of electric charge to reduce further the residual potential.

Moreover, improvement of the characteristics of the photoreceptor having the underlayer containing a water- or water/alcohol-soluble polyvinyl acetal and an inorganic pigment results in reduction of the image defect. Particularly, in the prior art, when the electric charge leaks from the conductive support into the photo-conductive layer, the image defect was accompanied with the process of inversion development of the photoreceptor, and appeared as dark spots all over the white image. In such a case, a polyvinyl acetal resin soluble in water or water/alcohol was used alone as the underlayer, so that the resin absorbs moisture and the ionic component in the resin acts on an electron-releasing material to yield readily an image defect such as dark spots. In this invention, however, it is considered that, since the underlayer contains a water- or water/alcohol-soluble polyvinyl acetal and a usually highly dielectric inorganic pigment, the partial voltage loaded on the underlayer is reduced even though the voltage on the photo-receptive layer remains constant at the time of the image formation, and the ionic component in the underlayer resin hardly acts on the charge-generating material to reduce occurrence of the image defect such as dark spots.

The thickness of the underlayer is fixed in a range of 0.1–20 $\mu$m, preferably, in 0.5–5 $\mu$m. When the thickness of the underlayer is smaller than 0.1 $\mu$m, the underlayer does not function substantially, no uniform surface covering the defect of the conductive support is obtained, and the carrier injection from the conductive support cannot be prevented to lower the electrically charged property. It is not appropriate to form the underlayer by immersion coating in a thickness of 20 $\mu$m or thicker since production of the photoreceptor becomes difficult and mechanical strength of the coating film decreases. In dispersing the liquid coating material for forming the underlayer, a ball mill, sand mill, atriter, vibrating mill, or ultrasonic disperser may be used. As for coating means, a common method such as the aforementioned immersion coating may be employed.

As for the conductive support, a metallic drum or sheet, e.g. aluminum, aluminum alloy, copper, zinc, stainless steel or titanium, or a drum or sheet or seamless belt prepared by performing a metal foil lamination or metal vapor deposition on a macro-molecular material, e.g. polyethylene terephthalate, nylon or polystyrene, or on a hard paper.

As for the structure of photoreceptive layer formed on the underlayer, there are two types, that is, a function-separating type consisting of two layers, i.e. charge-generating layer and charge-transporting layer, and a monolayer type in which the two layers are not separated to form a monolayer. Either of them may be employed.

In the function-separating type, the charge-generating layer is formed on the underlayer. The charge-generating material contained in the charge-generating layer includes bis-azo-type compounds, e.g. chlorodiane blue, polycyclic quinone compounds, e.g. dibromoanthanthrone, perillene type compounds, quinacridone type compounds, phthalocyanine type compounds and azulenium salt compounds. One or more species of them may be used in combination.

The charge-generating layer may be prepared by vapor deposition of a charge-generating material in vacuum or by dispersing it into an adhesive resin solution and applying the solution to form a coating layer. In general, the latter is preferred. In the latter case, the same method as in preparation of the underlayer may be applied in order that the charge-generating material is mixed and dispersed into an adhesive resin solution to form a coating film. The adhesive resin includes melamine resins, epoxy resins, silicon resins, poly-urethane resins, acryl resins, polycarbonate resins, polyarylate resins, phenoxy resins, butyral resins, and a repeating unit of two or more of them, as well as insulating resins such as copolymer resins, e.g. vinyl chloride-vinyl acetate copolymer, acrylonitrile-styrene copolymer. The resin is not limited to them, and all of the usually used resins may be used alone or in combination of two or more species. The solvent in which the resin is dissolved includes halogenohydrocarbons, e.g. dichloromethane, dichloroethane, ketones, e.g. acetone, methyl ethyl ketone, cyclohexanone, esters, e.g. ethyl acetate, butyl acetate, ethers, e.g. tetrahydrofuran, dioxane, aromatic hydrocarbons, e.g. benzene, toluene, xylene, and aprotic polar solvents, e.g. N,N-dimethylformamide, N,N-dimethylacetamide. The coating thickness of the charge-generating layer may be in a range of 0.05–5 $\mu$m, preferably, 0.1–1 $\mu$m.

In preparing the charge-transporting layer provided on the charge-generating layer, in general, a charge-transforming material is dissolved in an adhesive resin solution to give a liquid coating material for forming the charge-transportation, which is then applied to give a coating film. The charge-transporting material contained in the charge-transporting layer includes hydrazone-type compounds, pyrazoline-type compounds, triphenylamine-type compounds, triphenylmethane-type compounds, stilbene-type compounds, oxadiazole-type compounds and enamine-type compounds. These may be used alone or in combination of two or more species. As to the adhesive resin, the aforementioned resin used for the charge-generating layer may be used alone or in combination of two or more species. The charge-transporting layer may be prepared in the same manner as in the underlayer. The coating thickness of the charge-transporting layer is fixed in a range of 5–50 $\mu$m, preferably in 10–40 $\mu$m.

When the photoreceptive layer is a monolayer structure, the coating thickness of photoreceptive layer is fixed in a range of 5–50 $\mu$m, preferably in 10–40 $\mu$m.

Moreover, in order to improve the sensitivity and reduce the residual electric potential and the fatigue in repeated use, it is acceptable to add at least one or more of electron receptive materials such as quinone type compounds, e.g. parabenzoquinone, chloranil, tetrachloro-1,2-benioquinone, hydroquinone, 2,6-dimethylbenzoquinone, methyl-1,4-benzoquinone, α-naphthoquinone, β-naphthoquinone; nitro compounds, e.g. 2,4,7-trinitro-9-fluorenone, 1,3,6,8-tetranitrocarbazole, p-nitrobenzophenone, 2,4,5,7-tetra-nitro-9-fluorenone and 2-nitrofluorenone; and cyano compounds, e.g. tetracyanoethylene, 7,7,8,8-tetra-cyanoquinodimethane, 4-(p-nitrobenzoyloxy)-2',2'-dicyanovinylbenzene and 4-(m-nitrobenzoyloxy)-2',2'-dicyanovinylbenzene. Among these compounds, the fluorenone type compounds, quinone type compounds and the benzene derivatives substituted by an electron attracting group or groups such as Cl, CN, $NO_2$, etc. are particularly preferred.

In addition, ultraviolet absorbents or anti-oxidants of nitrogen-containing compounds such as benzoic acid, stilbene compounds or their derivatives, triazole compounds, imidazole compounds, oxadiazole compounds, thiazole compounds and their derivatives may be contained.

Moreover, if required, a protective layer may be provided in order to protect the surface of photo-receptive layer. As for the protective layer, a thermoplastic resin or light- or thermo-setting resin may be used. In the protective layer, an inorganic material such as the aforementioned ultraviolet absorbent, antioxidant or metal oxide, organic metallic compound and electron attracting substance may be contained. In addition, if required, a plasticizer or plasticizers such as dibasic acid ester, fatty acid ester, phosphoric acid ester, phthalic acid ester and chlorinated paraffin may be added to the photoreceptive layer and the surface protective layer to give workability and plasticity for the purpose of improving mechanical property. A leveling agent such as silicon resin may also be used.

DETAILED DESCRIPTION OF THE PREFERRED EMBODIMENT

EXAMPLE 1

An aluminum drum, 65 mm in diameter and 332 mm in length, was prepared. A mixture of 3 weight parts of titanium oxide TTO-55B (surface-treated with alumina, titanium oxide component: 91%; made by Ishihara Sangyo Kaisha Ltd.), 3 weight parts of water-soluble polyvinyl acetal resin KW-1 (made by Sekisui Chemical Co., Ltd.), 30 weight parts of water and 70 weight parts of methanol was dispersed with a paint shaker for 10 minutes to give a liquid coating material for forming the underlayer. The drum was immersed in the liquid coating material for forming the underlayer, then pulled up, and dried at 120° C. for 20 minutes to form the underlayer of 29 $\mu$m thickness on the drum. By the way, though the water-soluble polyvinyl acetal resin KW-1 is practically an aqueous solution, the weight has been described as solid content. The degree of acetal formation in the resin is 9 mol %.

Subsequently, a mixture of 2 weight parts of τ-type non-metallophthalocyanine Liophoton TPA-891 (made by Toyo Ink Mfg. Co., Ltd.), 2 weight parts of vinyl chloride-vinyl acetate-maleic acid copolymer SOLBIN M (made by Nisshin Chemical Co., Ltd.) and 100 weight parts of MEK (methyl ethyl ketone) was dispersed with a ball mill for 12 hours to give a liquid coating material for forming the charge-generating layer. The drum on which the underlayer had been formed was immersed in the liquid coating material for forming the charge-generating layer, then pulled up, and dried at 120° C. for 10 minutes to form the charge-generating layer of 0.39 $\mu$m thickness on the underlayer.

Furthermore, a mixture of 8 weight parts of a charge-transporting material of the following formula:

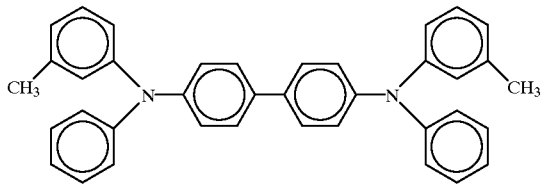

10 weight parts of polycarbonate resin K1300 (made by Teijin Chemical Ltd.), 0.002 weight part of silicon oil KF50 (made by Shin-Etsu Chemical Co., Ltd.) and 120 weight parts of dichloromethane was dissolved under stirring to give a liquid coating material for forming the charge-transporting layer. The drum on which the charge-generating layer was formed was immersed in the liquid coating material for forming the charge-transporting layer, then pulled up, and dried at 120° C. for 20 minutes to form the charge-transporting layer of 30 $\mu$m thickness over the charge-generating layer. The photoreceptor was produced in such a way.

EXAMPLE 2

In place of the liquid coating material for forming the underlayer as In Example 1, a mixture of 3 weight parts of titanium oxide TTO-55B (surface-treated with alumina, titanium oxide component: 91%; made by Ishihara Sangyo Kaisha Ltd.), 3 weight parts of water-soluble polyvinyl acetal resin KW-3 (made by Sekisui Chemical Co., Ltd.), 30 weight parts of water and 70 weight parts of methanol was used, but the other was made in the same manner as in Example 1 to give a photoreceptor. By the way, the degree of acetal formation in the water-soluble polyvinyl acetal resin KW-3 is 30 mol %.

EXAMPLE 3

In place of the liquid coating material for forming the underlayer as in Example 1, a mixture of 3 weight parts of zinc oxide FINEX-25 (made by Sakai Chemical Industry Co., Ltd.), 3 weight parts of water-soluble polyvinyl acetal resin KW-1 (made by Sekisui Chemical Co., Ltd.), 30 weight parts of water and 70 weight parts of methanol was used, but the other was made in the same manner as in Example 1 to give a photoreceptor.

Comparative Example 1

In place of the liquid coating material for forming the underlayer as in Example 1, a mixture of 6 weight parts of water-soluble polyvinyl acetal resin KW-1 (made by Sekisui Chemical Co., Ltd.), 30 weight parts of water and 70 weight parts of methanol was used, but the other was made in the same manner as in Example 1 to give a photoreceptor. The liquid coating material was stirred with a stirrer.

Comparative Example 2

In place of the liquid coating material for forming the underlayer as in Example 1, a mixture of 3 weight parts of titanium oxide TTO-55B (surface-treated with alumina, titanium oxide component: 91%; made by Ishthara Sangyo Kaisha Ltd.), 3 weight parts of alcohol-soluble nylon resin CM4000 (Toray Industries Inc.), 80 weight parts of methanol and 20 weight parts of n-butanol was used, but the other was made in the same manner as in Example 1 to give a photoreceptor.

Comparative Example 3

In place of the liquid coating material for forming the underlayer as in Example 1, a mixture of 3 weight parts of zinc oxide FINEX-25 (made by Sakai Chemical Industry Co., Ltd.), 3 weight parts of alcohol-soluble nylon resin CM4000 (Toray Industries Inc.), 80 weight parts of methanol and 20 weight parts of n-butanol was used, but the other was made in the same manner as in Example 1 to give a photoreceptor.

The photoreceptors described in Examples 1 to 3 and Comparative Examples 1 to 3 were installed in a modified version of digital copying machine AR5130 (made by Sharp Co., Ltd.) and subjected to a copying-durability test. Table 1 shows the results. The copying-durability test was carried out in an environment of lower temperature (10° C.) and lower humidity (15% RH) at the initial stage and after making of 30,000 sheets of copying image, respectively, to evaluate the potential VO(−V) at the dark portion and the potential VL(−V) at the light portion. It is favorable as to the sensitivity that the initial potential VL at the light portion is low, and it is also favorable as to the electrostatic stability that the changes of the potential VO at the dark portion and the potential VL at the light portion are small. Moreover, the photoreceptors of Examples 1 and Comparative Example 1 were installed in the aforementioned copying machine to form the entire white image, that is, white all over the sheet by the inversion development process. As a result, that of Example 1 afforded an intact image, and that of Comparative Example 1 afforded an image somewhat having dark spotted defects.

TABLE 1

| | | | Initial | | After 30,000 Sheet copying | |
|---|---|---|---|---|---|---|
| | Under-layer Inorg. pigment | Under-layer Resin | Poten-tial in dark VO(−V) | Poten-tial in light VL(−V) | Poten-tial in dark VO(−V) | Poten-tial in light VL(−V) |
| Ex. 1 | $TiO_2$ TTO-55B | KW-1 | 600 | 120 | 600 | 115 |
| Ex. 2 | $TiO_2$ TTO-55B | KW-3 | 600 | 130 | 590 | 130 |
| Ex. 3 | ZnO FINEX25 | KW-1 | 610 | 180 | 600 | 190 |
| C.Ex. 1 | None | KW-1 | 595 | 130 | 610 | 170 |
| C.Ex. 2 | $TiO_2$ TTO-55B | CM4000 | 600 | 120 | 605 | 200 |
| C.Ex. 3 | ZnO FINEX25 | CM4000 | 610 | 190 | 610 | 250 |

C.Ex.: Comparative Example

From the above results of evaluation, it was found that the photoreceptors having the underlayers of Examples 1 to 3 which contained a water-soluble polyvinyl acetal resin and an inorganic pigment have a higher potential stability than those having the underlayer of Comparative Examples 2 and 3 which contained an alcohol-soluble nylon resin and an inorganic pigment in repeated use. Moreover, it was found that the photoreceptors having the underlayers of Examples 1 to 3 which contained a water-soluble polyvinyl acetal resin and an inorganic pigment have a lesser image defect than that having the underlayer of Comparative Example 1 which contained no inorganic pigment. Particularly, it was also found that the use of titanium oxide in Examples 1 and 2 shows higher sensitivity than the use of zinc oxide in Example 3.

EXAMPLE 4

In the liquid coating material for forming the underlayer of Example 1, the content of titanium oxide was altered into 0.3 weight part and that of water-soluble polyvinyl acetal resin into 5.7 weight parts, res-pectively. The other was made in the same manner as in Example 1 to give a photoreceptor.

EXAMPLE 5

In the liquid coating material for forming the underlayer of Example 1, the content of titanium oxide was altered into 0.6 weight part and that of water-soluble polyvinyl acetal resin into 5.4 weight parts, res-pectively. The other was made in the same manner as in Example 1 to give a photoreceptor.

EXAMPLE 6

In the liquid coating material for forming the underlayer of Example 1, the content of titanium oxide was altered into 5.4 weight parts and that of water-soluble polyvinyl acetal resin into 0.6 weight part, res-pectively. The other was made in the same manner as in Example 1 to give a photoreceptor.

EXAMPLE 7

In the liquid coating material for forming the underlayer of Example 1, the content of titanium oxide was altered into 5.7 weight parts and that of water-soluble polyvinyl acetal resin into 0.3 weight part, res-pectively. The other was made in the same manner as in Example 1 to give a photoreceptor.

The photoreceptors prepared in Examples 1 and 4 to 7 were respectively installed in the aforementioned copying machine, and the copying durability test was carried out in the same manner. Table 2 shows the result. It was found that the photoreceptors which had the underlayers prepared in Examples 1, 5 and 6, in which the mixing ratios of titanium oxide/water-soluble polyvinyl acetal resin by weight were 1/9, 1/1 and 9/1, respectively, exhibited higher potential stability than the other ones of Examples 4 and 7 in repeated use.

TABLE 2

| | | Initial | | After 30,000 copy durability | |
|---|---|---|---|---|---|
| | $TiO_2$/Resin | Potential in dark VO(−V) | Potential in light VL(−V) | Potential in dark VO(−V) | Potential in light VL(−V) |
| Ex. 4 | 0.5/9.5 | 600 | 130 | 610 | 160 |
| Ex. 5 | 1/9 | 605 | 125 | 605 | 140 |
| Ex. 1 | 1/1 | 600 | 120 | 600 | 115 |
| Ex. 6 | 9/1 | 600 | 125 | 595 | 120 |
| Ex. 7 | 9.5/0.5 | 590 | 125 | 590 | 100 |

From the above results of evaluation, it was found that the photoreceptors having the underlayers in a range of titanium oxide/water-soluble polyvinyl acetal resin=1/9 to 9/1 exhibit high sensitivity and a high potential stability, particularly in repeated use.

EXAMPLE 8

In the underlayer of Example 1, the film thickness was altered to 0.3 μm. The other was made in the same manner as in Example 1 to give a photoreceptor.

EXAMPLE 9

In the underlayer of Example 1, the film thickness was altered to 0.5 μm. The other was made in the same manner as in Example 1 to give a photoreceptor.

EXAMPLE 10

In the underlayer of Example 1, the film thickness was altered to 5 μm. The other was made in the same manner as in Example 1 to give a photoreceptor.

EXAMPLE 11

In the underlayer of Example 1, the film thickness was altered to 7 μm. The other was made in the same manner as in Example 1 to give a photoreceptor.

The photoreceptors prepared in Examples 1 and 8 to 11 were respectively installed in the aforementioned copying machine, and the copying durability test was carried out in the same manner. Table 3 shows the result. It was found that the photoreceptors of Examples 1, 9 and 10 in which the thickness of the underlayer has been fixed to 0.5, 2 and 5 μm, exhibits higher potential stability than those of Examples 8 and 11 in repeated use.

TABLE 3

| | Under-layer Thickness (μm) | Initial | | After 30,000 copy durability | |
|---|---|---|---|---|---|
| | | Potential in dark VO(−V) | Potential in light VL(−V) | Potential in dark VO(−V) | Potential in light VL(−V) |
| Ex. 8 | 0.3 | 605 | 130 | 550 | 100 |
| Ex. 9 | 0.5 | 600 | 125 | 590 | 120 |
| Ex. 1 | 2 | 600 | 120 | 600 | 115 |
| Ex. 10 | 5 | 605 | 125 | 610 | 120 |
| Ex. 11 | 7 | 610 | 130 | 610 | 150 |

From the above results of evaluation, it was found that the photoreceptors having the underlayers in a range of 0.5–5 μm in thickness exhibit high sensitivity and high potential stability, particularly in repeated use.

EXAMPLE 12

In the liquid coating material for forming the underlayer of Example 1, the titanium oxide was changed into 3 weight parts of titanium oxide TTO-55N (surface-untreated, titanium oxide component: 98%; made by Ishihara Sangyo Kaisha Ltd.). The other was made in the same manner as in Example 1 to give a photoreceptor.

EXAMPLE 13

In the liquid coating material for forming the underlayer of Example 1, the titanium oxide was changed into 3 weight parts of titanium oxide TTO-55C (surface-treated with alumina+stearic acid, titanium oxide component: 89%; made by Ishihara Sangyo Kaisha Ltd.). The other was made in the same manner as in Example 1 to give a photoreceptor. By treatment of the surface with stearic acid, the dispersibility can be improved and an incidence of image defect can be reduced.

EXAMPLE 14

In the liquid coating material for forming the underlayer of Example 1, the titanium oxide was changed into 3 weight parts of titanium oxide TTO-55A (surface-treated with alumina, titanium oxide component: 96%; made by Ishihara Sangyo Kaisha Ltd.). The other was made in the same manner as in Example 1 to give a photoreceptor.

EXAMPLE 15

In the liquid coating material for forming the charge-generating layer of Example 1, the vinyl chloride-vinyl acetate-maleic acid copolymer was changed into 2 weight parts of epoxy resin BPO-20E (made by Riken Chemical Co., Ltd.). The other was made In the same manner as in Example 1 to give a photoreceptor.

EXAMPLE 16

In the liquid coating material for forming the underlayer of Example 1, the water-soluble polyvinyl acetal resin was changed into 3 weight parts of water-soluble polyvinyl acetal resin KW-10 (made by Sekisui Chemical Co., Ltd.). The other was made in the same manner as in Example 1 to give a photoreceptor. In Example 16, the sodium ion concentration of water-soluble poly-vinyl acetal resin KW-10 was 2,000 ppm, while that of water-soluble polyvinyl acetal resin KW-1 of Example 1 was 40 ppm.

The photoreceptors prepared in Examples 1 and 12 to 16 were respectively installed in the aforementioned copying machine, and the copying durability test was carried out in the same manner. Table 4 shows the result. Moreover, the photoreceptors of Examples 1 and 12 to 16 were installed in the aforementioned copying machine to form the entire white image, that is, white all over the sheet by the inversion development process. As a result, those of Examples 1 and 13 afforded an intact image, those of Examples 12 and 14 afforded an image somewhat having dark spotted defect, and those of Examples 15 and 16 afforded an image having dark spotted defect.

TABLE 4

| | | Initial | | After 30,000 copy durability | |
|---|---|---|---|---|---|
| | | Potential in dark VO(−V) | Potential in light VL(−V) | Potential in dark VO(−V) | Potential in light VL(−V) |
| Ex. 1 | $TiO_2$ Alumina (purity 91%) | 600 | 120 | 600 | 115 |
| Ex. 12 | $TiO_2$ untreat. (purity 98%) | 600 | 125 | 605 | 130 |
| Ex. 13 | $TiO_2$ Alumina + stearic acid (purity 89%) | 595 | 120 | 590 | 140 |
| Ex. 14 | $TiO_2$ Alumina (purity 96%) | 590 | 130 | 595 | 135 |
| Ex. 15 | Charge-generating layer resin of Example 1 to epoxy | 590 | 200 | 540 | 180 |
| Ex. 16 | Underlayer resin of Example 1 to KW-10 | 590 | 125 | 595 | 130 |

From the above results, it was found that the photoreceptors which have an underlayer containing titanium oxide treated with alumina, an underlayer containing titanium oxide of which the content of titanium oxide (purity) is 95% or lower, a charge-generating layer containing vinyl chloride-vinyl acetate type copolymer, and an underlayer containing a water-soluble polyvinyl acetal resin of which the sodium ion conconcentration is 40 ppm or lower, are particularly favorable in sensitivity, in potential stability in repeated use, and in image defect.

EXAMPLE 17

An aluminum drum, 65 mm in diameter and 332 mm in length, was prepared. A mixture of 3 weight parts of titanium oxide TTO-55B (surface-treated with alumina, titanium oxide component: 91%; made by Ishihara Sangyo Kaisha Ltd.), 3 weight parts of water-soluble polyvinyl acetal resin KW-1 (made by Sekisui Chemical Co., Ltd.), 5 weight parts of water and 95 weight parts of methanol was dispersed with a paint shaker for 10 hours to give a liquid coating material for forming the underlayer. The drum was immersed in the liquid coating material for forming the underlayer, then pulled up, and dried at 120° C. for 20 minutes to form the underlayer of 2 μm thickness on the drum. By the way, though the water-soluble polyvinyl acetal resin KW-1 is practically an aqueous solution, the weight has been described as solid content.

EXAMPLE 18

In the liquid coating material for forming the underlayer of Example 17, the amounts of water and methanol to be used were altered to 10 weight parts and 90 weight parts, respectively. The other was made in the same manner as in Example 17 to give an underlayer.

EXAMPLE 19

In the liquid coating material for forming the underlayer of Example 17, the amounts of water and methanol to be used were altered to 70 weight parts and 30 weight parts, respectively. The other was made in the same manner as in Example 17 to give an underlayer.

EXAMPLE 20

In the liquid coating material for forming the underlayer of Example 17, the amounts of water and methanol to be used were altered to 80 weight parts and 20 weight parts, respectively. The other was made in the same manner as in Example 17 to give an underlayer.

EXAMPLE 21

In the liquid coating material for forming the underlayer of Example 17, water and methanol were altered to 100 weight parts of water and no methanol was used. The other was made in the same manner as in Example 17 to give an underlayer.

The underlayers prepared in Examples 17 to 21 were observed visually. In Example 17, the resin did not dissolve completely to yield a coating defect. In Examples 18 and 19, an intact coating film was produced. In Example 20, the pigment was insufficiently dispersed to yield a defect in the coating film. In Example 21, there was such a defect in the coating film that the drum repelled the liquid coating material. From the above result of evaluation, a mixture of water and alcohol was found to be favorable as a dispersing medium for forming the underlayer. Particularly, it was found that the mixing ratio of water to alcohol is in a range of 1/9–7/3 (water/alcohol)by weight.

EXAMPLE 22

An aluminum drum, 65 mm in diameter and 332 mm in length, was prepared. A mixture of 3 weight parts of titanium oxide TTO-55B (surface-treated with alumina, titanium oxide component: 91%; made by Ishihara Sangyo Kaisha Ltd.), 3 weight parts of water/alcohol-soluble polyvinyl acetal resin KX-1 (purified product made by Sekisui Chemical Co., Ltd.), 60 weight parts of water and 40 weight parts of isopropyl alcohol was dispersed with a paint shaker for 10 hours to give a liquid coating material for forming the underlayer. The drum was immersed in the liquid coating material for forming the underlayer, then pulled up, and dried at 120° C. for 20 minutes to form the underlayer of 2 μm thickness on the drum. By the way, the water/alcohol-soluble polyvinyl acetal resin KX-1 is soluble only in a mixture of water/alcohol to give practically a water/alcohol solution, which is however described in weight as a solid component in this specification. Moreover, the purified KX-1 product has been prepared to be 40 ppm or lower as the sodium ion concentration.

Next, a mixture of 2 weight parts of titanyl phthalocyanine, 2 weight parts of vinyl chloride-vinyl acetate-vinyl alcohol copolymer SOLBIN A (Nisshin Chemical Co., Ltd.) and 100 weight parts of MEK was dispersed with a paint shaker for 2 hours to give a liquid coating material for forming the charge-generating layer. The drum on which had been formed the underlayer was immersed in the liquid coating material for forming the charge-generating layer, then pulled up and dried at 80° C. for 10 minutes to form the charge-generating layer of 0.3 μm thickness over the underlayer.

Moreover, a mixture of 8 weight parts of a charge-transporting material of the following formula:

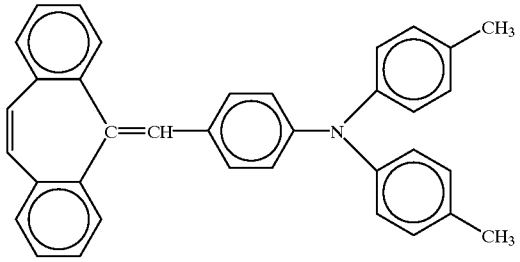

10 weight parts of polycarbonate resin K1300 (made by Teijin Chemical Ltd.), 0.002 weight part of silicon oil KF50 (made by Shin-Etsu Chemical Co., Ltd.) and 120 weight parts of dichloromethane was dissolved with stirring to give a liquid coating material for forming the charge-transporting layer. The drum on which has been formed the charge-generating layer was immersed in the liquid coating material for forming the charge-transporting layer, then pulled up and dried at 120° C. for 20 minutes to form a charge-transporting layer of 30 μm thickness over the charge-generating layer. Thus, a photo-receptor was produced.

EXAMPLE 23

In place of the liquid coating material for forming the underlayer of Example 22, a mixture of 3 weight parts of zinc oxide FINEX-25 (made by Sakai Chemical Industry Co., Ltd.), 3 weight parts of water/alcohol-soluble polyvinyl acetal resin KX-1 (purified product of Sekisui Chemical Co., Ltd.), 60 weight parts of water and 40 weight parts of isopropyl alcohol was used. The other was made in the same manner as in Example 22 to give a photoreceptor.

Comparative Example 4

In place of the liquid coating material for forming the underlayer of Example 22, a mixture of 6 weight parts of water/alcohol-soluble polyvinyl acetal resin KX-1 (made by Sekisui Chemical Co., Ltd.), 60 weight parts of water and 40 weight parts of isopropyl alcohol was used. The other was made in the same manner as in Example 22 to give a photoreceptor. Said liquid coating material was stirred with a stirrer.

Comparative Example 5

In place of the liquid coating material for forming the underlayer of Example 22, a mixture of 3 weight parts of titanium oxide TTO-55B (surface-treated with alumina, titanium oxide component: 91%; made by Ishihara Sangyo Kaisha, Ltd.), 3 weight parts of alcohol-soluble nylon resin CM4000 (made by Toray Industries Inc.), 80 weight parts of methanol and 20 weight parts of n-butanol was used. The other was made in the same manner as in Example 22 to give a photoreceptor.

Comparative Example 6

In place of the liquid coating material for forming the underlayer of Example 22, a mixture of 3 weight parts of zinc oxide FINEX-25 (made by Sakai Chemical Industry Co., Ltd.), 3 weight parts of alcohol-soluble nylon resin CM4000 (made by Toray Industries Inc.), 80 weight parts of methanol and 20 weight parts of n-butanol was used. The other was made in the same manner as in Example 22 to give a photoreceptor.

The photoreceptors prepared in Examples 22 and 23 and Comparative Examples 4 to 6 were respectively installed in the aforementioned copying machine, and the copying durability test was carried out in the same manner. Table 5 shows the result. Moreover, the photoreceptors of Example 22 and Comparative Example 4 were installed in the aforementioned copying machine to form the entire white image, that is, white all over the sheet by the inversion development process. As a result, that of Example 22 afforded an intact image, and that of Comparative Example 4 afforded an image somewhat having dark spotted defect.

TABLE 5

| | Underlayer Inorganic pigment | Underlayer Resin | Initial Potential in dark VO(−V) | Initial Potential in light VL(−V) | After 30,000 copy durability Potential in dark VO(−V) | After 30,000 copy durability Potential in light VL(−V) |
|---|---|---|---|---|---|---|
| Ex. 22 | $TiO_2$ TTO-55B | KX-1 | 655 | 110 | 655 | 105 |
| Ex. 23 | ZnO FINEX-25 | KX-1 | 665 | 170 | 655 | 180 |
| C.Ex. 4 | None | KX-1 | 650 | 120 | 665 | 160 |
| C.Ex. 5 | $TiO_2$ TTO-55B | CM4000 | 655 | 110 | 660 | 190 |
| C.Ex. 6 | ZnO FINEX-25 | CM4000 | 665 | 180 | 665 | 240 |

C.Ex.: Comparative Example

From the above result of evaluation, it was found that the photoreceptors of Examples 22 and 23 having the underlayers which contain the water/alcohol-soluble polyvinyl acetal and the inorganic pigment exhibited higher potential stability in repeated use than the photoreceptor of Comparative Example 4 having the underlayer containing water/alcohol-soluble polyvinyl acetal and no inorganic pigment or than those of Comparative Examples 5 and 6 containing the alcohol-soluble nylon resin and inorganic pigment. Particularly, the photoreceptor of Example 22 containing titanium oxide was found to have much higher sensitivity than that of Example 23 containing zinc oxide.

EXAMPLE 24

In the liquid coating material for forming the underlayer of Example 22, the amount of titanium oxide and that of water/alcohol-soluble polyvinyl acetal resin were altered to 0.3 weight part and 5.7 weight parts, respectively. The other was made in the same manner as in Example 22 to give an underlayer.

EXAMPLE 25

In the liquid coating material for forming the underlayer of Example 22, the amount of titanium oxide and that of water/alcohol-soluble polyvinyl acetal resin were altered to 0.6 weight part and 5.4 weight parts, respectively. The other was made in the same manner as in Example 22 to give an underlayer.

EXAMPLE 26

In the liquid coating material for forming the underlayer of Example 22, the amount of titanium oxide and that of water/alcohol-soluble polyvinyl acetal resin were altered to 5.4 weight parts and 0.6 weight part, respectively. The other was made in the same manner as in Example 22 to give an underlayer.

EXAMPLE 27

In the liquid coating material for forming the underlayer of Example 22, the amount of titanium oxide and that of water/alcohol-soluble polyvinyl acetal resin were altered to 5.7 weight parts and 0.3 weight part, respectively. The other was made in the same manner as in Example 22 to give an underlayer.

The photoreceptors prepared in Examples 22 and 24 to 27 were respectively installed in the aforementioned copying machine, and the copying durability test was carried out in the same manner. Table 6 shows the result. It was found that the photoreceptors having the underlayers of which the ratio of titanium oxide to the water/alcohol-soluble polyvinyl acetal resin by weight was in 1/9, 1/1 or 9/1 (titanium oxide/(water/alcohol)-soluble polyvinyl acetal resin) exhibited high potential stability in repeated use.

TABLE 6

| | | Initial | | After 30,000 copy durability | |
|---|---|---|---|---|---|
| | Ratio of $TiO_2$/Resin | Potential in dark VO(−V) | Potential in light VL(−V) | Potential in dark VO(−V) | Potential in light VL(−V) |
| Ex. 24 | 0.5/9.5 | 650 | 120 | 660 | 150 |
| Ex. 25 | 1/9 | 655 | 115 | 655 | 130 |
| Ex. 22 | 1/1 | 650 | 110 | 650 | 105 |
| Ex. 26 | 9/1 | 650 | 115 | 645 | 110 |
| Ex. 27 | 9.5/0.5 | 640 | 115 | 640 | 90 |

From the above results of evaluation, the photoreceptors having the underlayers in which the ratio of titanium oxide/(water/alcohol)-soluble polyvinyl acetal resin was in a range of 1/9–9/1 (ratio by weight) were found to have high sensitivity and high potential stability, particularly in repeated use.

EXAMPLE 28

In the underlayer of Example 22, the film thickness was altered to 0.3 μm. The other was made in the same manner as in Example 22 to give a photoreceptor.

EXAMPLE 29

In the underlayer of Example 22, the film thickness was altered to 0.5 μm. The other was made in the same manner as in Example 22 to give a photoreceptor.

EXAMPLE 30

In the underlayer of Example 22, the film thickness was altered to 5 μm. The other was made in the same manner as in Example 22 to give a photoreceptor.

EXAMPLE 31

In the underlayer of Example 22, the film thickness was altered to 7 μm. The other was made in the same manner as in Example 22 to give a photoreceptor.

The photoreceptors prepared in Examples 22 and 28 to 31 were respectively installed in the aforementioned copying machine, and the copying durability test was carried out in the same manner. Table 7 shows the result. The photoreceptors of Examples 22, 29 and 30 in which the thickness of the underlayers was fixed at 0.5, 2 and 5 μm, respectively, were found to exhibit higher potential stability than those of Examples 28 and 31 in repeated use.

TABLE 7

| | Thickness of the | Initial | | After 30,000 copy durability | |
|---|---|---|---|---|---|
| | under-layer (μm) | Potential in dark VO(−V) | Potential in light VL(−V) | Potential in dark VO(−V) | Potential in light VL(−V) |
| Ex. 28 | 0.3 | 655 | 120 | 600 | 90 |
| Ex. 29 | 0.5 | 650 | 115 | 640 | 110 |
| Ex. 22 | 2 | 650 | 110 | 650 | 105 |
| Ex. 30 | 5 | 655 | 115 | 660 | 110 |
| Ex. 31 | 7 | 660 | 120 | 660 | 140 |

From the above results of evaluation, the photoreceptors having the underlayers of which the thickness was in a range of 0.5–5 μm were found to exhibit high sensitivity and high electric potential stability particularly in repeated use.

EXAMPLE 32

In the liquid coating material for forming the underlayer of Example 22, titanium oxide was altered to 3 weight parts of titanium oxide TTO-55N (surface untreated; titanium oxide component: 98%; made by Ishihara Sangyo Kaisha Ltd.). The other was made in the same manner as in Example 22 to give a photoreceptor.

EXAMPLE 33

In the liquid coating material for forming the underlayer of Example 22, titanium oxide was altered to 3 weight parts of titanium oxide TTO-55C (surface-treated with alumina+stearic acid; titanium oxide component: 89%; made by Ishihara Sangyo Kaisha Ltd.). The other was made in the same manner as in Example 22 to give a photoreceptor.

EXAMPLE 34

In the liquid coating material for forming the underlayer of Example 22, titanium oxide was altered to 3 weight part of titanium oxide TTO-55A (surface-treated with alumina, titanium oxide component: 96%; made by Ishihara Sangyo Kaisha Ltd.). The other was made in the same manner as in Example 22 to give a photoreceptor.

EXAMPLE 35

In the liquid coating material for forming the charge-generating layer, the vinyl chloride-vinyl acetate-vinyl alcohol copolymer was altered to 2 weight parts of epoxy resin BPO-20E (made by Riken Chemical Co., Ltd.). The other was made in the same manner as in Example 22 to give a photoreceptor.

EXAMPLE 36

In the liquid coating material for forming the underlayer of Example 1, the water/alcohol-soluble poly-vinyl acetal resin was altered to 3 weight parts-of water/alcohol-soluble polyvinyl acetal resin KX-1 (made by Sekisui Chemical Co., Ltd.). The other was made in the same manner as in Example 22 to give a photoreceptor. By the way, the sodium ion concen-tration in the water/alcohol-soluble polyvinyl acetal resin KX-1 in Example 36 is 2,000 ppm, while that of the purified product of water/alcohol-soluble polyvinyl acetal resin KX-1 in Example 22 is 40 ppm.

The photoreceptors prepared in Examples 22 and 32 to 36 were respectively installed in the aforementioned copying machine, and the copying durability test was carried out in the same manner. Table 8 shows the results. Moreover, the photoreceptors of Examples 22 and 32 to 36 were installed in the aforementioned copying machine to form the entire white image, that is, white all over the sheet by the inversion development process. As a result, those of Examples 22 and 33 afforded an intact image, those of Examples 32 and 34 afforded an image somewhat having dark spotted defect, and those of Examples 35 and 36 afforded an image having dark spotted defect.

TABLE 4

| | | Initial | | After 30,000 copy durability | |
|---|---|---|---|---|---|
| | | Potential in dark VO(−V) | Potential in light VL(−V) | Potential in dark VO(−V) | Potential in light VL(−V) |
| Ex. 22 | $TiO_2$ Alumina (purity 91%) | 650 | 110 | 650 | 105 |
| Ex. 32 | $TiO_2$ untreated (purity 98%) | 650 | 115 | 655 | 120 |
| Ex. 33 | $TiO_2$ Alumina + stearic acid (purity 89%) | 645 | 110 | 640 | 130 |
| Ex. 34 | $TiO_2$ Alumina (purity 96%) | 640 | 120 | 645 | 125 |
| Ex. 35 | Charge-generating layer resin of Example 22 to epoxy | 640 | 190 | 590 | 170 |
| Ex. 36 | Underlayer resin of Example 22 to KX-1 | 640 | 115 | 645 | 120 |

From the above results, it was found that the photoreceptors which have an underlayer containing titanium oxide treated with alumina, an underlayer containing titanium oxide of which the content of titanium oxide (purity) is 95%. or lower, a charge-generating layer containing vinyl chloride-vinyl acetate type copolymer, and an underlayer containing a water-soluble polyvinyl acetal resin of which the sodium ion concentration is 40 ppm or lower, are particularly favorable in sensitivity, in electric potential stability in repeated use, and in image defect.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An electrophotographic photoreceptor used in an inversion development process comprising:

a photoconductive layer;

a conductive support; and an underlayer, the photoconductive layer being provided on the conductive support via the underlayer, wherein the underlayer contains an inorganic pigment and a polyvinyl acetal soluble only in a mixture of water and alcohol.

2. The electrophotographic photoreceptor of claim 1, wherein titanium oxide is selected as the inorganic pigment.

3. The electrophotographic photoreceptor of claim 2, wherein a ratio of titanium oxide to the polyvinyl acetal soluble only in a mixture of water and alcohol is in a range of 1/9–9/1 (as titanium oxide/polyvinyl acetal) by weight.

4. The electrophotographic photoreceptor of claim 2, wherein the titanium oxide is treated with alumina.

5. The electrophotographic photoreceptor of claim 1, wherein a sodium ion concentration in the polyvinyl acetal soluble only in a mixture of water and alcohol is 40 ppm or lower.

6. The electrophotographic photoreceotor of claim 1, wherein the photoconductive layer contains a copolymer of vinyl chloride-vinyl acetate.

7. The electrophotographic photoreceptor of claim 1, wherein the underlayer is formed by applying a liquid coating material on the conductive support for forming an underlayer, and wherein the liquid coating material comprises the inorganic pigment, the polyvinyl acetal and a mixture of water and alcohol and driving the liquid coating to provide the underlayer.

8. The electrophotographic photoreceptor of claim 7, wherein a ratio of water to alcohol of the mixture is in a range of 1/9–7/3 (as water/alcohol) by weight.

* * * * *